United States Patent [19]

Smith

[11] 4,108,255

[45] Aug. 22, 1978

[54] WELL DRILLING APPARATUS

[76] Inventor: Craig R. Smith, 1317 Center St., Redlands, Calif. 92373

[21] Appl. No.: 719,573

[22] Filed: Sep. 1, 1976

Related U.S. Application Data

[63] Continuation-in-part of Ser. No. 581,936, May 29, 1975.

[51] Int. Cl.[2] ..... E21B 7/12; E02B 17/02

[52] U.S. Cl. ..... 175/9; 52/29; 52/245; 52/311; 61/88

[58] Field of Search ..... 175/5, 6, 8, 9, 108, 175/85, 52, 50; 61/85, 86, 88; 52/224, 245, 311, 2, DIG. 12, 29

[56] References Cited

U.S. PATENT DOCUMENTS

| | | | |
|---|---|---|---|
| 1,478,396 | 12/1923 | Pownall | 52/29 |
| 2,472,869 | 6/1949 | Travers, Jr. | 175/8 |
| 2,872,933 | 2/1959 | Mackey | 52/2 |
| 2,937,006 | 5/1960 | Thayer | 175/6 |
| 3,095,048 | 6/1963 | O'Neill et al. | 175/6 |
| 3,191,388 | 6/1965 | Ludwig | 61/88 |
| 3,412,564 | 11/1968 | McClintock | 61/88 |
| 3,456,720 | 7/1969 | Brewer | 175/8 X |
| 3,661,204 | 5/1972 | Blanding et al. | 175/6 |
| 3,713,968 | 1/1973 | Kennedy | 52/224 |

FOREIGN PATENT DOCUMENTS

| | | | |
|---|---|---|---|
| 1,532,547 | 7/1968 | France | 52/98 |

*Primary Examiner*—Ernest R. Purser
*Assistant Examiner*—William F. Pate, III
*Attorney, Agent, or Firm*—Fulwider, Patton, Rieber, Lee & Utecht

[57] ABSTRACT

An apparatus is provided for drilling concurrently a plurality of wells within a laterally confined area. The confines of the drilling apparatus employ a structure having vertically extending walls rising from a drilling floor. A plurality of wells are drilled, each employing a separate rotary drilling table and a separate draw work assembly mounted in vertical displacement from the drilling table associated there with. Preferably, the individual draw work assemblies associated with separate one of the rotary drilling tables are utilized only to feed drilling pipe assemblies into the well and to aid in the actual drilling operation. To withdraw drilling pipe assemblies, a master draw works is provided and is mounted vertically above the draw work assemblies associated with particular rotary drilling tables. In addition, the draw work assemblies are preferably located on bridges which are rotatably mounted with respect to an upright central support, so that the bridges are rotatable about the upright support and carriages forming part of the draw works are movable along the bridges so that the carriages may be moved both radially and rotationally relative to the upright support. The confining structure of the vertically extending walls renders the well drilling apparatus suitable for construction for use in drilling wells on the floor of a body of water and also for use in drilling a plurality of wells in a highly urbanized areas. This versatility is achieved by constructing the well drilling apparatus with exterior walls of the confining structure in the form of a facade, to resemble a commercial building or in the form of a water resistant cassion that may be lowered into a body of water to extend from the floor to the surface thereof.

15 Claims, 11 Drawing Figures

112
118
44
40
42
42'
116
118
120
122
252
252
124
196
126
252
128
252
202
202
132
130
134
140

138
136
138

WELL DRILLING APPARATUS

The present invention is a continuation-in-part of U.S. patent application Ser. No. 581,936, filed on May 29, 1975.

FIELD OF THE INVENTION

The present invention relates to well drilling apparatus and structure for use in drilling for and producing oil, natural gas, pure water, and occassionally various types of brines or geothermal steam and the like.

BACKGROUND OF THE INVENTION

The present invention relates to a new and improved concept in oil, gas or water drilling systems and offers significant economies in equipment acquisition, well drilling and in the cost and time required to drill and bring into production fluid producing wells. The invention is suitable for use in environments and areas that would otherwise preclude fluid mineral development due to population congestion or ecological considerations. The system of the invention is adaptable for use in either on shore or offshore oil, gas or water well drilling with advantageous efficiencies in economies for both forms of application. While it is to be understood that the invention has utility in drilling for any type of subsurface fluid, the embodiments discussed herein are approached from the standpoint of drilling for crude oil.

In offshore applications, wells are conventionally drilled from a platform that is mounted on a substructure that extends from the floor of the ocean to a level located above a designated storm wave elevation. Conventional structures usually consist of a series of crossed braced steel legs, Alternatively, drilling operations are conventionally conducted from semi-submersible floating platforms.

These conventional structures employ a single drilling derrick and machinery located on the platform for drilling a single well at any particular time. The platform usually contains living quarters for the drilling and operating crews. A plurality of wells may be drilled from such platforms by slant drilling techniques, so that the locations wherein the wells intersect the underground oil production formations are laterally displaced from the platform by hundreds or thousands of feet. Furthermore, the wells must be drilled serially, that is one at a time. As each well is completed, the derrick and drilling equipment are moved to a new location on the platform where a subsequent well is drilled. Hence, if 30 wells are involved in the drilling program, it normally takes on the order of 60 months to complete all wells. Currently, drilling platforms normally cost from $30,000 to $50,000 per day to operate, so that the total cost for just rig drilling time runs from 54 to 90 million dollars. Full production from conventional platforms can not be realized until the final well is completed, which, as previously stated, is of the order of 60 months.

Conventional land based wells likewise involve the erection of a derrick above a well drilling location to drill a single well at a time. Drilling pipe sections are lifted into position and lowered to be joined with existing drilling pipe sections. When pipe is to be withdrawn for changing bits, stands of pipe (usually three drilling pipe sections linearly joined together) are withdrawn from the well using the derrick structure. Such conventional drilling structures involve the use of an unsightly derrick and are designed to drill but a single well at a time. These disadvantageous features have virtually precluded conventional well drilling apparatus from being located in highly urbanized locations because the aesthetic appearance of such conventional drilling rigs is unacceptable to the surrounding community, and because the economic realities of drilling a single well in each of several different area locations on land of high real estate value defeat the profitability of such undertakings.

Accordingly, it is an object of the present invention to provide a well drilling apparatus that is capable of drilling a plurality of wells concurrently. Utilizing the four well drilling configuration depicted herein, a drilling program could be completed in sixteen months as contrasted with the more conventional period for a well drilling program of sixty months. The resulting savings at current rates amount to from 40 to 65 million dollars. As significant as the savings are, they still do not entirely reflect the economic advantage of producing oil in time then would otherwise be possible. With increasing dependence on foreign oil resources, this feature may well be the most important aspect of the present invention.

A further object of the invention is to drill a plurality of wells within the confines of a single drilling structure without requiring complete redundancy of equipment for each well drilled concurrently. That is, in the preferred form of the invention, major items of equipment may be devoted on a time shared basis to the various wells concurrently drilled as these wells require the use of such equipment. By utilizing said major items of equipment on such such a time shared basis, substantial savings are achieved in connection with the equipment that must dedicated for use in drilling a particular well. Most significant in this regard is the use of a master drilling draw works, which is used to draw drilling pipe from wells in stands of pipe, each stand representing a plurality of linearly joined sections of drilling pipe. In conventional practice, on the other hand, the derrick associated with each individual well is of a height and structural capability to withdraw a stand of pipe in order to change drill bits. Thus, in conventional practice the concurrent drilling of four different well requires the construction of four derricks, each associated with a separate one of the wells, and each capable of withdrawing a stand of pipe. In contrast, however, according to the present invention, a single master drilling draw works is provided and is used on a time shared basis to withdraw stands of pipe from wells as drill bit changes are required in connection with the pipe being used to drill each of the wells. This allows a much smaller draw work assembly to be used with each of the rotary drilling tables to perform the more frequently required function of feeding additional drill sections of pipe into the well as the well is drilled deeper and deeper.

Another object of the invention in its land based application is to provide a well drilling structure that is acceptable to govermental authorities and not objectionable to surrounding inhabitants for drilling wells in urbanized areas. The confinement of drilling operations to a small area and the location of the drilling structure within an aesthetically compatible facade allows drilling to proceed in urbanized areas where drilling would otherwise be entirely unacceptable to surrounding community.

A further object of the invention in connection with the land based application of the well drilling apparatus of this invention is to provide a well drilling system which is entirely enclosed within a structure having verticallly extending walls that rise from the drilling floor and surround and encase all of the necessary equipment. Such a structure is most useful in guarding against theft and vandalism. The security provided by the enclosure and the confinement of the drilling equipment to a relatively small and protected area adds further to the economic attractiveness of the utilization of the invention disclosed herein.

Yet another object of the invention is the confinement of the surface area of the fluidized mineral production field to a few hundred square feet, in contrast to conventional land based drilling fields which extend over many square miles. A producing complex that covers the same subsurface area as a conventional oil field, but which is concentrated at the surface by virtue of slant drilling techniques into a small enclosed area reduces substantially the installation cost, and the cost of maintenance and operation of oil and gas gathering lines. The probability of line breakage and oil spills is likewise reduced. Furthermore, since the entire surface complex is enclosed within a single large structure, means for containing spills are easily made a part of the design so that pollution of the environment is averted.

An additional advantage of the invention as applied to drilling at the floor of bodies of water is that the housing for the invention may be constructed to initially float in water. Thus, the structure may be floated on the surface of the body of water to a drilling cite where a plurality of wells are to be drilled concurrently at the sea floor of the body of water from within the structure. One end of the structure may be filled with water so that end sinks towards the floor of the body of water thereby orienting the structure vertically as it descends. Water may be continued to be introduced into the sinking end of the structure until that end reaches the floor of the body of water. The height of the structure, should be designed so that the structure extends from the floor to surface of the body of the water. The hollow structure may be secured in position at the floor of the body of water by pouring a material, such as concrete, into or around the sunken end of the structure to hold it in position. Llateral protuberances from the structure may be employed to assure bonding of the concrete to the walls of the structure. The foregoing concept of caisson deployment is explained at greater length in U.S. patent application Ser. No. 581,936, filed on May 29, 1975.

Once the sunken end of the structure is secured in position at the floor of the body of water, a bottom seal is formed across the interior of the sunken end of the structure. Water is pumped out from within the structure and thereafter the structure is maintained in a relatively water free condition. Of course it is to be understood that minor leaks will invariably occur, and a pumping system should be utilized to ensure that the structure is indeed maintained water free.

It is essential that the sunken end of the structure be secured in position on the floor of the body of water prior to evauation of the water from within the structure, as the water free condition of the structure produces a strong tendency for the surrounding sea water to push the structure up toward the surface.

Several significant advantages are provided by utilizing the hollow water free structure of the invention. The well drillling apparatus of this invention as applied to offshore driling minimizes the adverse consequences that can occur if oil escapes from the wells in the floor of the sea bottom. This is because escaping oil will be confined within the vertically extending walls, and so cannot cause ecological damage. Furthermore oil well fires are easily extinguished, since the drilling surface is located far below the water level surface at the exterior of the structure. Thus, the provision of inlets provides a ready supply of water to extinguish any fires that might break out.

Another problem that occurs with conventional offshore drilling apparatus is that heavy seas and weather conditions reduce drilling activity by personnel aboard semi-submersible floating platforms and platforms supported on leg structures to an absolute minimum. This materially adds to the time required to complete the drilling operations and bring the wells into a producing capability.

In one broad aspect the present invention is a well drilling apparatus located within a confining structure having vertically extending walls rising from a drilling floor and enclosing: a plurality of rotary drilling tables laterally displaced from each other proximate to the drilling floor. Each of the rotary drilling tables is arranged to accomodate a separate drilling assembly, which assembly includes drilling pipe for drilling separate wells at spacially separate locations at the drilling floor. Separate drilling draw work assemblies are likewise associated with and mounted in vertical displacement from each of the rotary drilling tables. These separate drilling draw work assemblies are used for manipulating the drilling pipe and other portions of the drilling assembly utilized with the associated rotary table.

While utilizing rotary drilling tables, mud pumps, shaker tables, tanks, and draw works of conventional design, the invention resides in the relocation of the pieces of equipment and the addition of necessary equipment to achieve multiple drilling capablity within a confined area and without complete cross section throughout the height of the confining structure of the well drilling apparatus of the invention, there is ample room for a multiplicity of drilling draw works.

While these draw works are of a conventional design, there arrangement and positioning radically departs from the arrangements heretofore employed. More specifically, the draw works of the present invention are repackaged into a bridge crane type of mechanism and are relocated from their conventional position on the drilling platform to an overhead traveling mechanism. If a tall structure is used that contains a master drilling draw work assembly in addition to the draw works separately associated with each drilling table, a minimum height for the bridge mounting of the separate draw works is on the order of 45 feet. This allows enough room to install additional sections of drilling pipe as the hole is deepened using the draw works dedicated for use with a particular rotary table. These dedicated draw works, however, are used only for drilling the well. A single master draw work assembly is located in the upper portion of the structure above the upper extremity of any of the separate dedicated draw works, and is used to pull pipe from the hole of the well when it is necessary to change bits or conduct bottom hole operations. A conventional derrick pulls three joints of drilling pipe at a time, about 90 feet. Thus, if a well is at a 9,000 foot depth, 100 stands of pipe would have to be removed from the hole and leaned against the side of the derrick for temporary storage. In the apparatus of the present invention, on the other hand, the confining structure with upright vertical walls rising from the drilling floor is about 300 feet high. Each stand of pipe may therefore be about 240 feet long so that it would be necessary to draw only 38 stands of pipe and hang them in temporary storage for the same 9,000 foot well. This represents a 62% savings in both time and manpower.

If desirable, the height of the confining structure of the invention can be limited to that of a conventional derrick, about 140 feet. The master draw works would then be at an equivalent height to the normal crown blocks in the derrick and would also hoist the 90 foot stand of drilling pipe and would require and equivalent amount of manpower and time to extract pipe from a well, change bits or perform other bottom hole operations, and replace the pipe in the well. However, a substantial savings in manpower and equipment is still available since the same master draw works can be used in association with a plurality of well holes.

DETAILED DESCRIPTION OF THE INVENTION

The various advantages and features of the invention may be explained with greater particularity and clarity by reference to the accompanying drawings in which FIG. 1 illustrates a confining structure constructed according to the invention with an external facade resembling a commercial building.

DETAILED DESCRIPTION OF THE DRAWINGS

Figure 1:
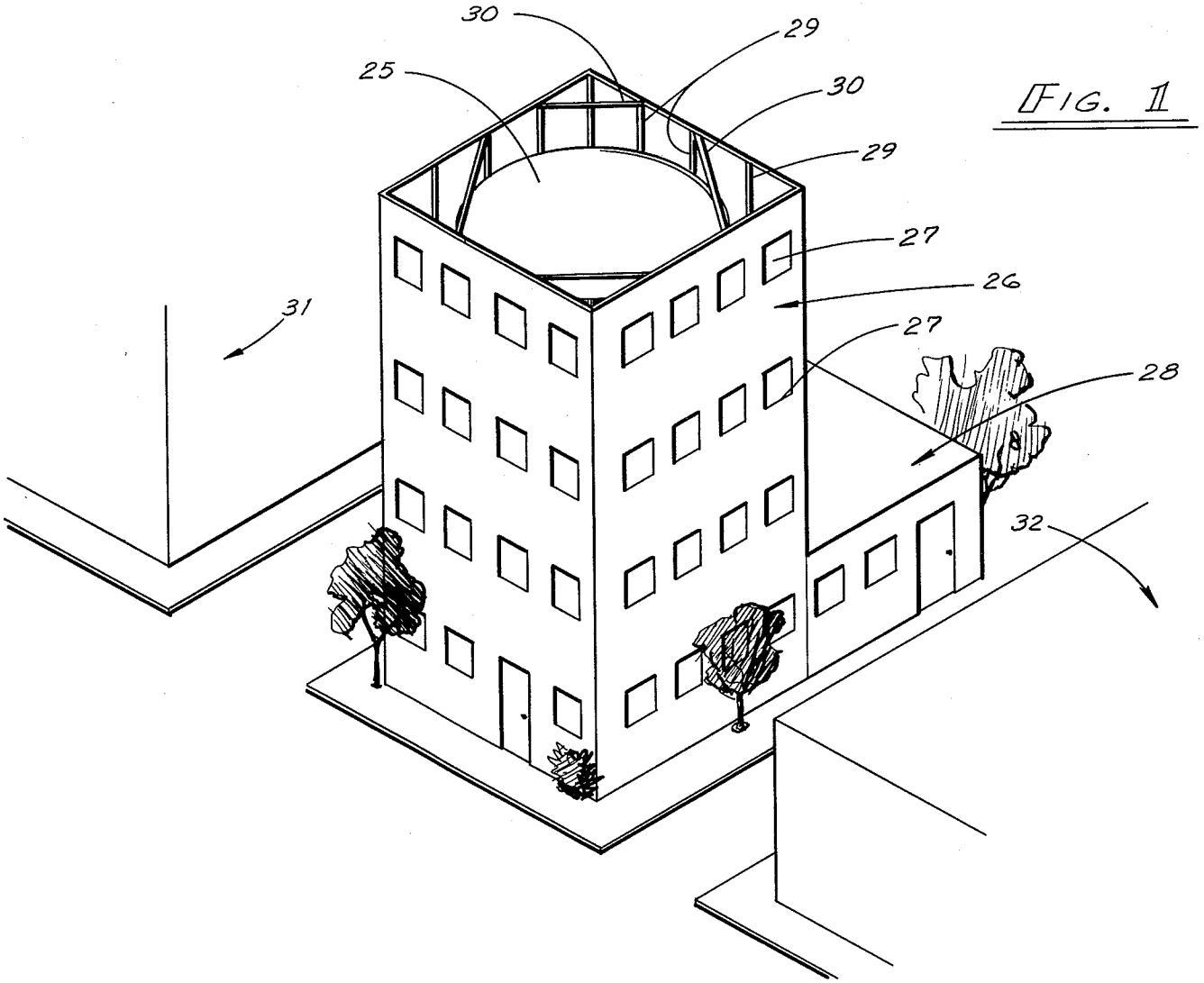

Referring now to FIG. 1 there is depicted the well drilling apparatus of this invention as it may be utilized in an on shore drilling operation in an urbanized area. As can be seen, the confining structure 25 is constructed with an external facade 26 resembling a rectalinear commercial structure. The facade is complete with simulated window appertures 27. In the on shore drilling application it is not necessary to locate the drilling support functions and apparatus above the rotary drilling tables and draw works as would be necessary in connection with an offshore well drilling apparatus. Rather, a contiguous drilling support building 28 is provided to house the prime mover and power generation equipment, the control and conditioning equipment and panels, the mud system consisting of tanks, shaker tables and pumps and office and storage space. The confining structure 25 is constructed with a surrounding steel framework including upright support members 29 and lateral cross braces 30 at the corners of the building facade.

The facade itself may be built of conventional building materials. While there is little functional requirement for building materials of high quality or durability from the stand point of structural demands, the quality of adjacent buildings 31 and 32 and the general character of the neighborhood within an urbanized area may dictate that certain minimum standards of building materials be utilized. This requirement for aesthetic appearances and the requirement for soundproofing to prevent drilling operations from distrubing surrounding building occupants usually dictate the installation of walls of one type or another. In a situation as depicted where urban conditions exist, minimum curtain walls that give the appearance of a conventional high rise building may be required with soundproofing material being added in those areas containing the noisiest operating equipment.

The size of the main drilling structure within the facade 26 is a variable depending upon the number of wells to be drilled from the single location and the ultimate amount of storage required during the production phase of the field. Typically, the facade 26 would necessarily be at least 50 feet by 50 feet on a size and could be as large as 250 feet by 250 feet. The height of the structure would range between 140 feet as a minimum, the height of a standard drilling derrick, and approximately 350 to 400 feet as an upper limit. The upper limit would be determined by economic considerations rather than technical limitations.

The ground level of the drilling building 26 contains the well head equipment and blow out preventors. The floor level contains the rotary tables and the driller's control station and is the normal drilling platform. This level is located approximately 20 feet above ground level. The drilling draw works are located a sufficient height above the drilling platform to permit installation and removal of equipment in association with the rotary drilling tables. This distance should be approximately 45 feet. In a four well drilling configuration, two sets of draw works are located at this level while the other two are located at a level 15 feet above the first level.

Figure 2:
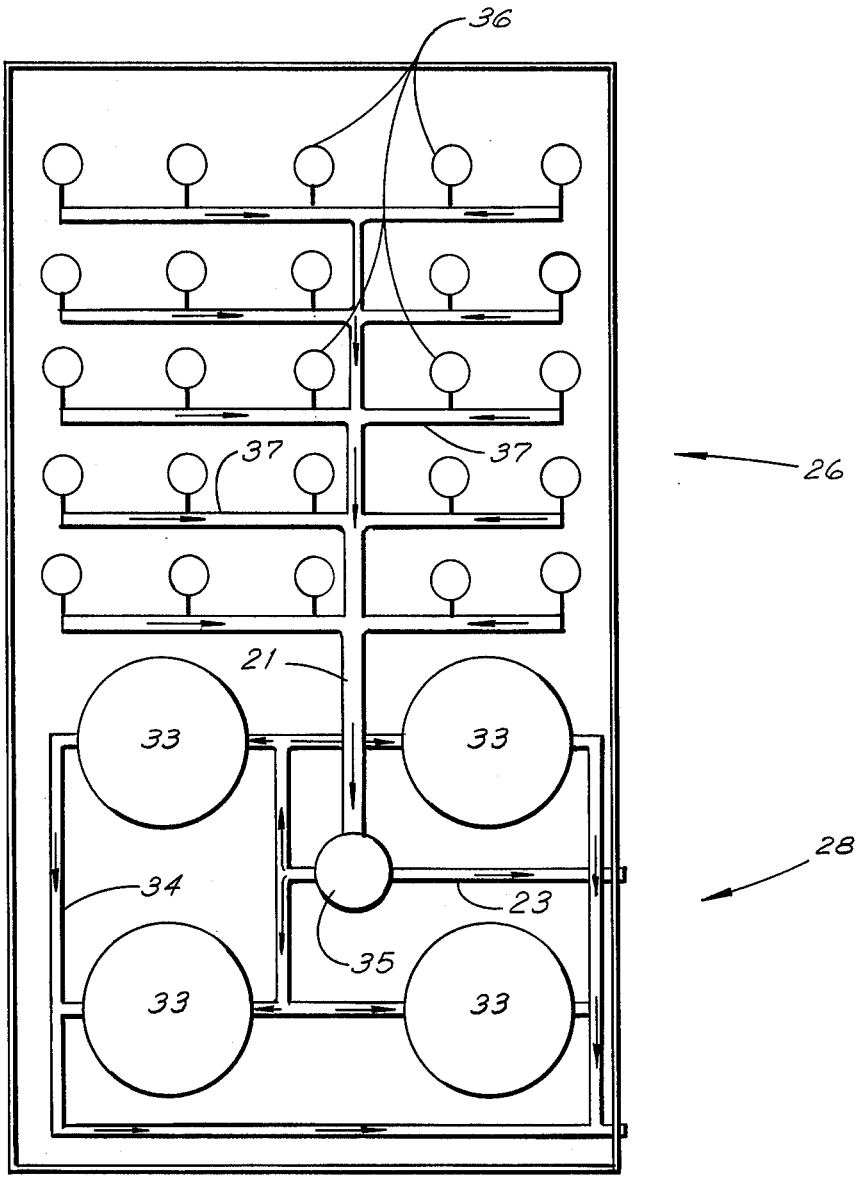
FIG. 2 is a plan view of the structure of FIG. 1 as it is arranged once drilling operations are complete and the structure is utilized for the ongoing protection of fluid minerals.

FIG. 2 illustrates the structure of FIG. 1 after it has been modified to support the production phase of operations. In the production phase, several of the upper stories of the building 26 may be removed, since the height requirement is significantly reduced following the cessation of drilling operations. During the production phase, producing wells 36 are connected to crude oil gathering lines 37 which channel the flow of oil to a main duct 21 that leads to an oil and gas separator 35. A gas line 23 is used to withdraw natural gas from the gas-crude oil separator 35, while oil lines 34 are used to transport crude oil from the separator 35 to oil storage tanks 33.

It can be seen that both during the drilling phase and during the production phase, the well drilling apparatus of this invention is suitable for use in highly urbanized areas as it is not aesthetically objectionable and does not contribute to a change of character of the neighborhood in which it is located.

Figure 3:
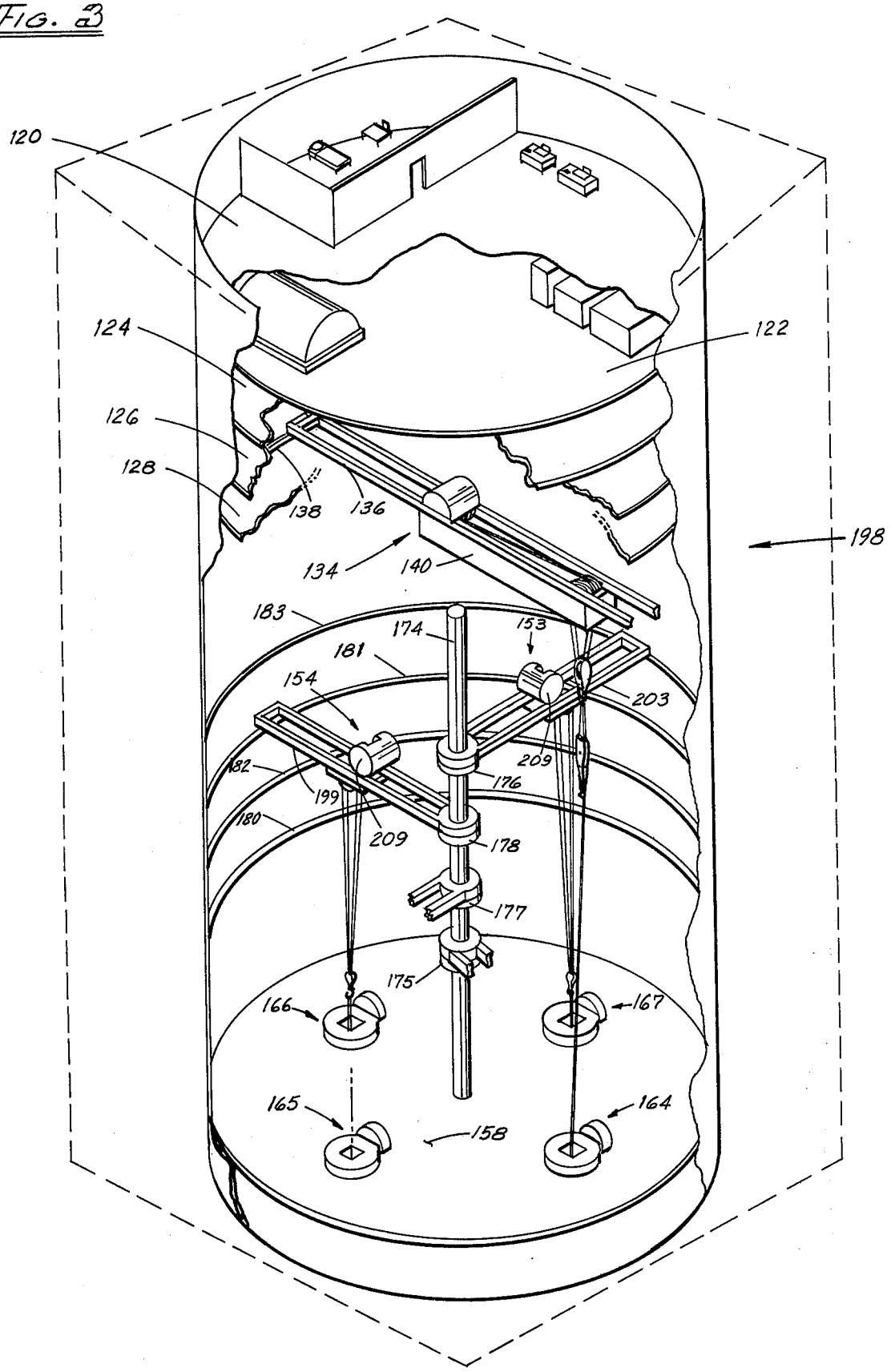
FIG. 3 is a perspective view of the structure of the invention arranged to concurrently drill a plurality of wells.
Figures 4, 4A, 4B, 4C:
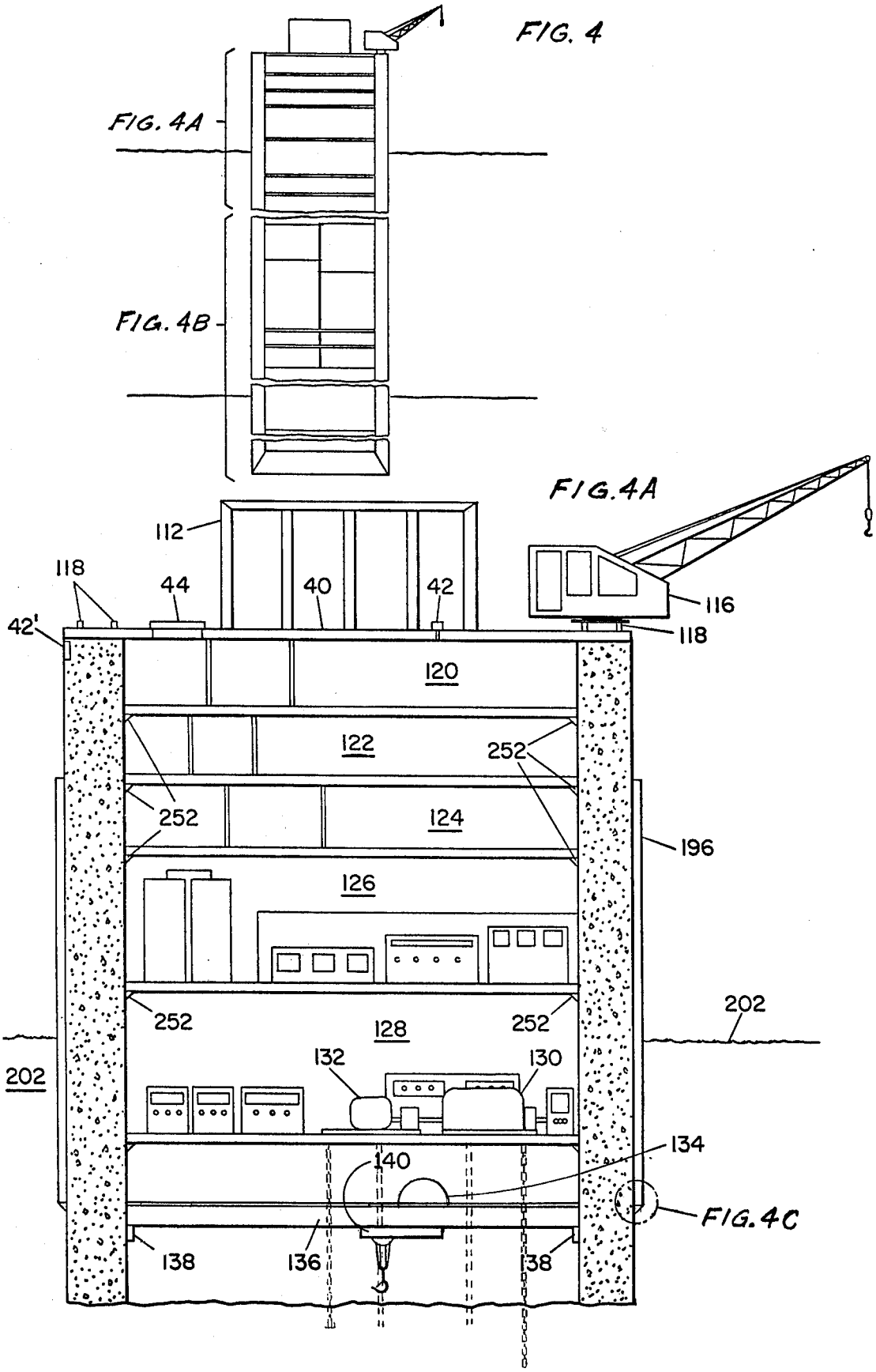
FIG. 4 and FIGS. 4A through 4B are assembly drawings depicting a well drilling structure according to the invention adapted for use in an offshore environment.
FIGS. 4C and 4D shows details of specific features of the structure.
Figure 4B:
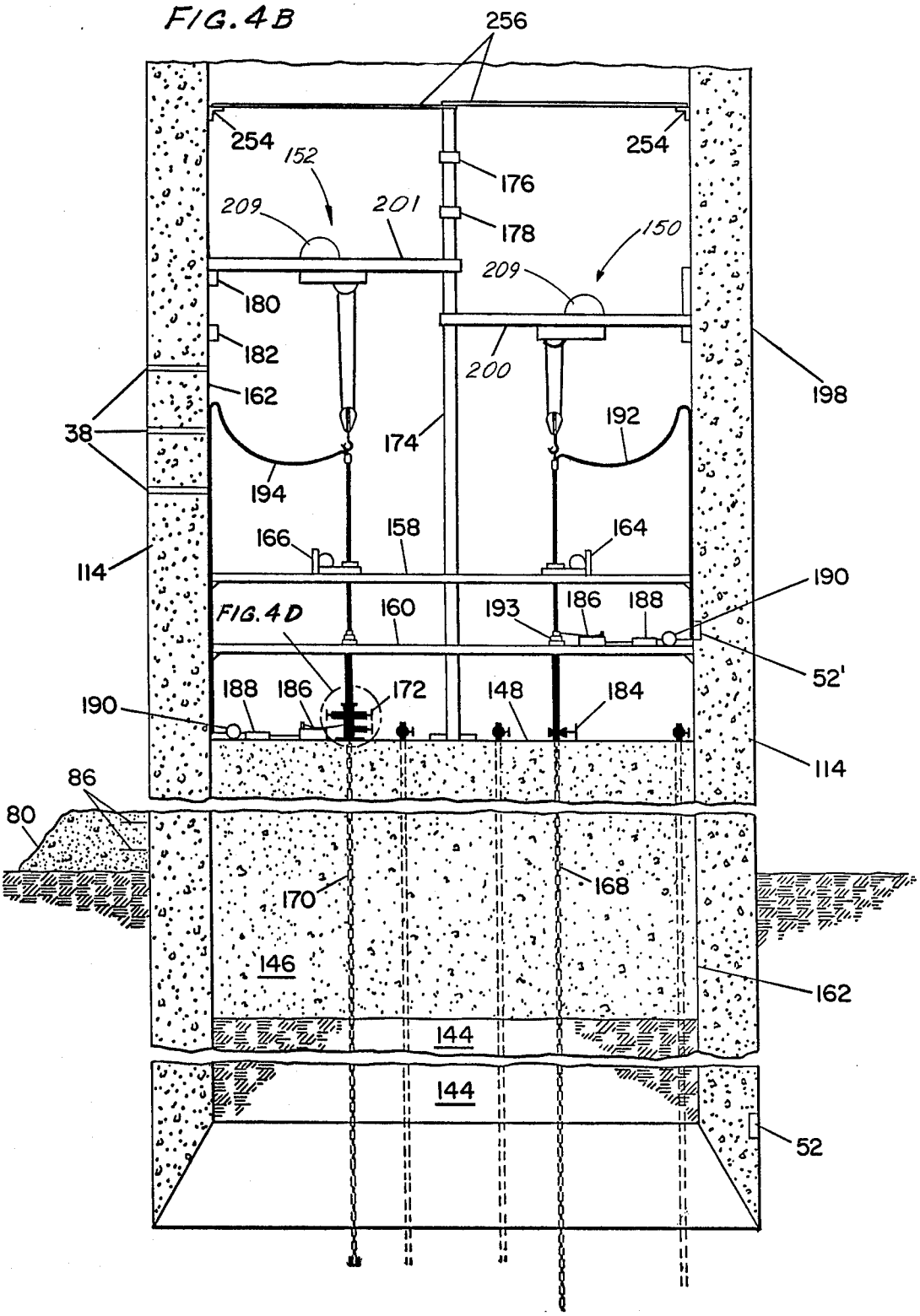
Figure 4C:
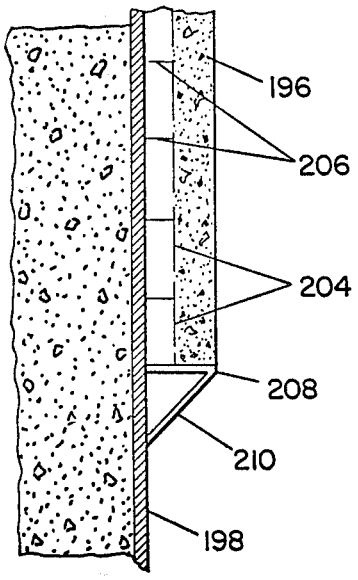
Figure 4D:
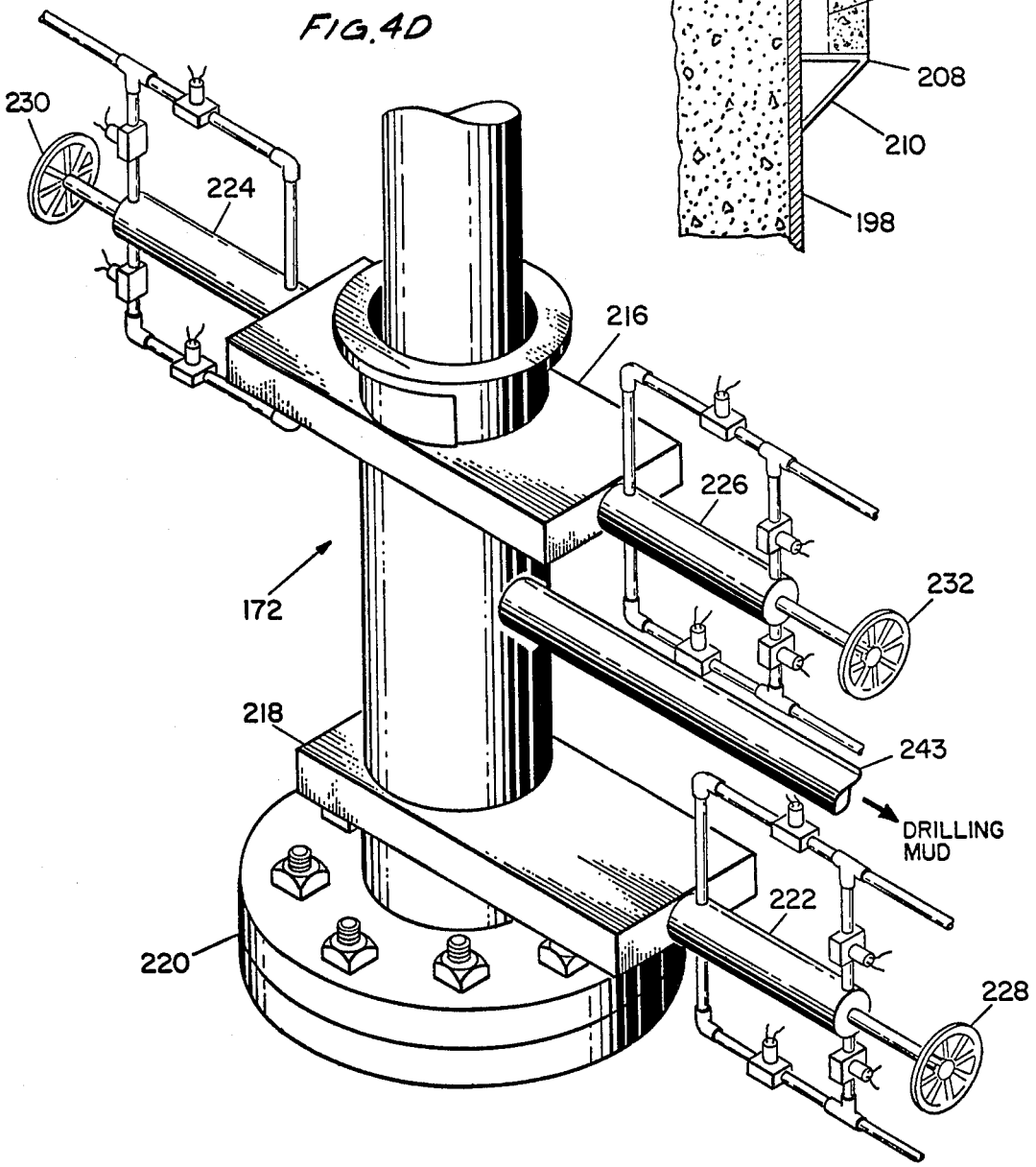

As previously explained, the well drilling apparatus of the invention is suitable for use both as an on shore drilling arrangement, as depicted in FIGS. 1 and 2, as and for offshore drilling. FIGS. 3 and 4 depict an embodiment of the invention suitable for use in water depths of about 600 feet, although the dashed rectalinear confining outline of FIG. 3 shows clearly that the structure thereof may likewise be adapted for on shore drilling in the urbanized environment of FIGS. 1 and 2. In FIG. 4, two of the bridges and drilling work assemblies have been removed to illustrate their manner of mounting.

In the illustrative embodiment of FIGS. 3 and 4, and with particular reference to FIG. 4, the structure extends about 110 feet below the ocean floor, and the top of the upper main deck of the platform 40 may be about 72 feet above the sea level, with the helicopter platform 112 being 20 feet higher. Accordingly, the overall height of the well drilling apparatus is approximately 802 feet.

For normal sea conditions, the outer diameter of the cyclindrical structure 198 should be about 100 feet, with the thickness of the vertically extending walls 114 rising from the drilling floor 148 being about 10 feet, or 10 percent of the outer diameter. This leaves an interworking cross sectional area of about 80 feet in diameter.

At the top of the structure of FIG. 4, a crane 116 mounted on rails 118 is provided for handling and moving heavy equipment. The four upper decks 120, 122, 124 and 126 are used for offices and personnel living and support. The three upper decks of the platform 120, 122 and 124 are used for personnel offices, dining facilities, lounge, recreation and living facilities for example. On level 126, heating, ventilating and other personnel support equipment is provided. Level 128 includes one or more prime movers 130, electrical generators 132 and/or suitable hydraulic power equipment, together with the necessary control and safety panels. At the lower end of the caisson structure 198 a concrete bottom seal 146 or other suitable means is used to close the lower end of the cyclinderal structure. A concrete collar so engaging protruding rods 86 aids in holding the structure 198 at the bottom of the sea floor. By the use of a caisson, essentially dry land drilling conditions are provided at the upper drilling surface 148 of the bottom seal 146.

In accordance with one feature of the invention, a plurality of rotary drilling tables 164, 165, 166 and 167 are provided laterally displaced from each other and proximate to the drilling floor 148, considering the overall height of the confining structure 198. Each of the rotary drilling tables is arranged to accomodate separate drilling assemblies including drilling pipe for drilling separate wells at spatially separated locations at the drilling floor, such as the wells 168 and 170. Separate drilling draw work assemblies 150, 152, 153 and 154 are associated with an mounted in vertical displacement from each of the rotary drilling tables. Each of the separate drilling draw work assemblies is dedicated for use with a particular rotary drilling table. That is, the drilling draw work assembly 150 is dedicated for use with the rotary drilling table 164 while the drilling draw work assembly 152 is used with the rotary drilling table 165. By the same token, the drilling draw work assembly 154 is used with the rotary drilling table 166 while the drilling draw work assembly 153 is used with the rotary drilling table 167. The individual drilling draw work assemblies are used for manipulating the drilling pipe and other portions of the drilling assembly utilized with the rotary table associated therewith.

A centralized upright support 174 is secured to and extends upward relative to the drilling floor 148 within the confining structure 198. Each of the separate drilling draw work assemblies 150, 152, 153 and 154 is mounted on a separate bridge. These bridges are numbered 200, 201, 199, and 203 are each respectively associated with a particular drilling draw work assembly as indicated. Each of the separate bridges extends laterally from the upright support 174 and is rotablable about that upright support to move horizontally. In this manner, each of the drilling draw work assemblies may be moved into and out of the vertical alignment with the rotary drilling table associated there with. Each of the separate bridges 200, 201, 202 and 203 extends laterally from the upright support 174 and is supported at the interior surface of vertically extending walls 114 of the structure 198 at a distance above the rotary drilling table with which it is associated. Preferably this distance is at least 45 feet so that the block and tackle assemblies associated with each of the draw works may be raised to a sufficient height to allow a conventional length of drilling pipe to be suspended and moved freely within the confines of the structure 198.

Each of the drilling draw work assemblies includes a carriage 209 that supports a pulley system from which a pipe section hook is suspended. These carriage assemblies are mounted in mobile fashion on their associated bridges for selected movement toward and away from the upright support 174.

The confining structure 198 is constructed with a framework in the form of concrete walls 114 of generally cyclindrical configuration. Attached to the wall 114 in circles at the interior surface thereof are a plurality of vertically displaced annular rails 180, 181, 182 and 183. These rails are congruent in plan view and encircle the upright support 174. These rails thereby provide support for the bridges 200, 201, 199 and 203 at the vertically extending wall 114.

A master drilling draw work assembly 134 is located in upward displacement above all of the dedicated drilling draw work assemblies 150, 152, 153 and 154 respectively associated with the drilling tables 164, 165, 166 and 167. The master drilling draw works 134 can thereby be selectively used to draw pipe from any one of the separate wells. Preferably, the master drilling draw work assembly 134 is mounted at least 90 feet above the rotary drilling tables so that a stand of at least 3 drilling pipe sections of conventional length can be moved freely within the confines of the walls 114 while strung together. Thus, if it is desired to withdraw drill pipe from the well 168 for the purpose of changing drill bits, or for any other reason, the bridge 200 is moved rotationally about the upright support 174 along the circular annular rail 183. The carriage 140 of the master draw works 134 is mounted in mobile fashion on a bridge 136 that extends between opposing walls 114 of the confining structure 198. Therefore, the carriage 140 can be moved into direct vertical alignment with the rotary drilling table 164. The block and tackle assembly of the master draw works 134 may then be lowered and secured to the uppermost pipe section. A stand of pipe may then be withdrawn upward by reeling in the lines of the master draw work assembly 134. The individual pipe sections do not need to be disconnected however. Rather, a stand of pipe is withdrawn in a length limited only by the height of the master draw works 134 above the drilling table 164. Thus, the changing of drill bits or other maintenance work proceeds at a much rapid pace then is possible with conventional well drilling apparatus.

The dedicated draw work assembly 150 is normally rotated into position directly above the drilling table 164 to feed pipe sections into the well 168. Since the requirement for changing drill bits is much less frequent then the requirement for adding pipe sections, a single master drilling draw work 134 is adequate to service a plurality of rotary drilling tables.

It might be noted that the bridge 136 upon which the master draw works 134 is located extends across the diameter of the confining structure 198 and is rotatable in a horizontal place therein with its ends traveling along the circular rail 138. This allows the bridge to move rotationally while the carriage 140 of the master draw works may be moved toward or away from the center of the structure. Selected combinations of rotational and radial movement of the carriage of the master draw work assembly is thereby effected. The carriage 140 of the master draw 134 134 may thereby be vertically aligned with any one of the rotary drilling tables. The master draw works 134 provide duty lifting capacity.

At the lower end of the caisson 198 a concrete plug 146 or other suitable bottom seal is poured close to the lower end of the cyclindrical caisson. By the use of a caisson, essentially dry land drilling conditions are provided at the upper surface 148 of the plug 146. Furthermore, the support for the drilling draw works 150, 152, 153 and 154 and for the drilling platform 158, as well as the drilling mud system level 160 are provided from the inner steel wall surface 162 of the structure.

In accordance with one feature of the invention the various draw works depicted within the caisson are s employed in place of several oil well derricks used in dry land drilling. More specifically, the drilling draw work assemblies 150, 152, 153 and 154 are located at a suitable elevation, such as 45 feet, above the drilling platform 158 so that additional length of pipe may be readily brought into place and added to the drilling strings. It may be noted that four or more wells may be drilled concurrently.

In FIG. 4, the well 168 drilled by table 164 is in an advanced stage of drilling, while the well 170, being drilled by rotary table 166, has just reached beyond the lower end of the cyclindrical structure. The drilling of well 168 has advanced to the point where it is reached an impermeable subsurface layer. Up to this stage the drilling is undertaken with relatively large diameter drilling bits, such as 12 inch to 13 inch diameter pipe to execavate for what is known as a "surface string" of pipe. After an impermeable layer is reached, the large diameter surface string of casing pipe is cemented into the hole, and drilling is continued through the surface string with smaller diameter bits, under conditions isolated from surface problems such as cave-ins from the loose sediment or the like.

The details of the valve and seal structure 172, used to prevent water seepage and flow in the early stages of drilling will be reviewed below in connection with FIG. 4D and FIGS. 5 through 7.

Returning to other aspects of the structure shown in FIG. 4, it may be noted that the drilling draw works 150, 152, 153 and 154 are supported in the center by the column 174. This may be a steel pipe filled with concrete. Support blocks 176, 178, etc., are secured to support column 174 to support the working drilling draw works 150, 152, 153, and 154. Suitable rails 180, 181, 182 and 183 are secured to the inner surface 162 of the wall 114. The outer end of the support members for the drilling draw works 150, 152, 153 and 154 may be moved around on rails 180, 181, 182, and 183 to facilitate the drilling of holes at any desired point on the surface of the concrete plug 146.

Returning to the surface 148 of the bottom seal 146, a conventional blowout preventor 184 is provided in the well 168 just above the surface. As mentioned above, well 168 has been drilled into impermeable subsurface formations and the surface string of pipe has been cemented into position to permit deeper drilling under controlled conditions. At this stage, the blowout preventor 184 is substituted for the valve and seal assembly 172. The drilling mud systems including mud screen 186, mud tank 188 and mud pump 190 are located on level 160. Mud lines 192 and 194 are provided to feed the drilling mud into the drill pipes to facilitate drilling action by the enlarged drilling bits at the ends of the strings of pipe. Of course, the drilling mud comes back up around the outside of the drilling string, and is taken off in seal assembly 172 or assembly 193 and routed to the drilling mud system for recirculation to the drilling operation.

The nature of the shut-off valve and drilling seal assembly 172 is considered in greater detail in connection FIG. 4D and FIGS. 5 through 7. As noted, in many cases the offshore confining structure will be located where the ocean floor consists of permeable sediments. During the initial phase before impermeable geologic formations are encountered, seepage and water flow through the holes drilled through the bottom seal 146 are likely to occur, and could flood the drilling structure. The assembly 172 precludes this possiblity.

Figure 5:
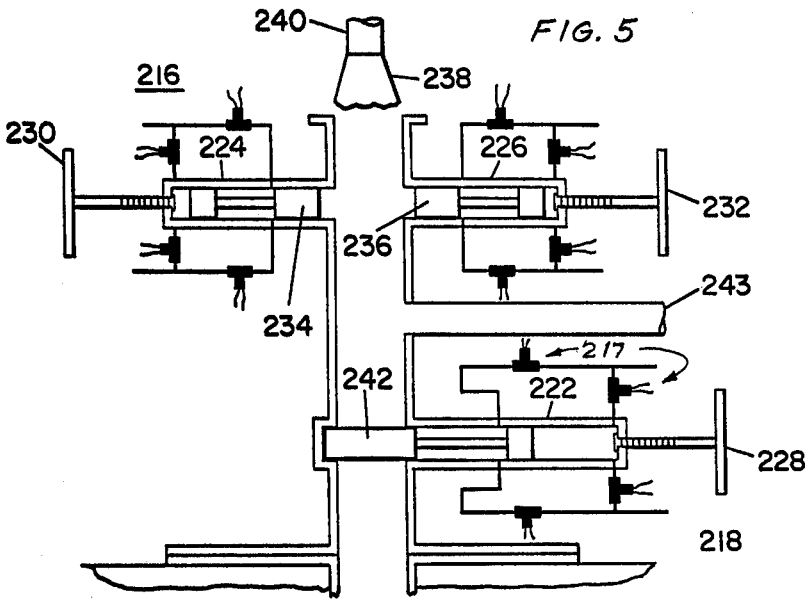
FIGS. 5 through 7, inclusive, are views showing the mode of operation of the seepage prevention assembly of FIG. 4D.
Figure 6:
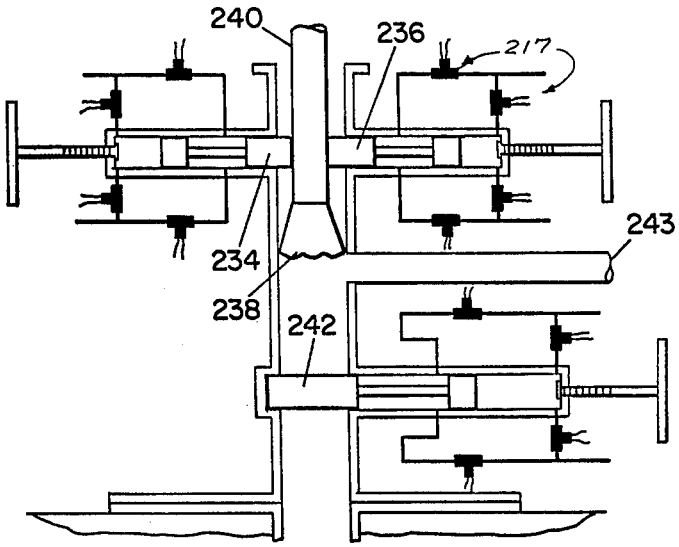
Figure 7:
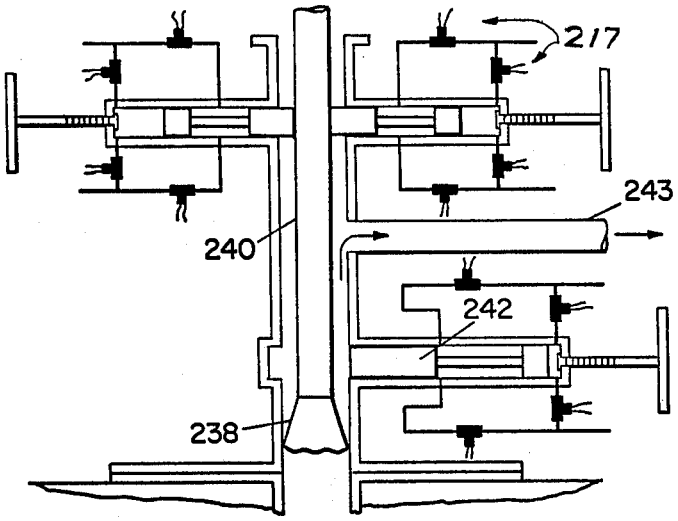

More specifically, as shown in FIGS. 4D and 5 through 7, the upper drilling seal assembly 216 and the lower shut-off valve assembly 218 are operated as indicated by the steps shown in FIGS. 5 through 7 to achieve this result during drilling operations. The component parts of the assembly include the base 220 which is securely fastened to the bottom sealing member 146, the single hydraulic cylinder 22 for the shut-off valve 218, and the two hydraulic actuating cylinders 224 and 226 for the drilling seal assembly 216. Electrically operated hydraulic system valves 217 are provided and the usual back-up operating hand wheels 228, 230 and 232 are associated with each hydraulic cylinder.

The upper sealing assembly 216 includes two movable sealing members 234 and 236 having semicircular faces. These two actuating members can be retracted, as shown in FIG. 5 to permit the passage of the oversized drill bit 238. They can then be hydraulically advanced, as shown in FIG. 6 to engage the smaller diameter drill bit 240 after the drilling bit or tool 238 has been lowered past assembly 216. The cylindrical bearing surfaces of sealing members 234 and 236 are preferably made of teflon or like material, coated on the steel sealing members 234, 236 to provide a long wearing bearing surface in contact with the rotating drill pipe.

Once the drilling seal members 234, 236 have been advanced as shown in FIG. 6 the shut off valve member 234 is retracted, as shown in FIG. 7 and the drilling tool 238 may be lowered to continue drilling operations. Similarly, of course, in the process of withdrawing the drilling pipe 240 and drilling bit 238, the drilling bit is first raised to a position as shown in FIG. 6, above the shut-off valve 242 in assembly 218. Then the shut-off valve 242 is closed, and subsequently the drilling seal members 234 and 236 are retracted to permit passage of the tool bit to the position shown in FIG. 5.

Incidentally, as indicated by the arrows in FIG. 7, the drilling mud return pad is along the outside of drill pipe 240 and out through pipe 243 to the mud systems screen tank and pump.

Reference will now be made to FIG. 4A and FIG. 4C which shows an outer concrete shell 196 for preventing corrsion to the structure 198. The upper concrete shell 196 extends well above and below the normal ocean level 202 to prevent corrosion in the wave and splash area where the corrosive action of the salt water and air is most active. The shell 196 may be reinforced by a wire screen or steel mesh 204 supported from spacer bars 206 secured to the outer steel shell 198. The concrete cylinder 196 is supported at its lower rim by shelf 208 and angle brackets 210. Regarding dimensions, it is preferably from 6 to 18 inches in thickness. This concrete shield 196 may be particularly desirable where the outer steel cylinder is used to support ship mooring brackets or for other purposes, where the strength of the outer steel cylinder must be preserved.

Various modifications of the invention as depicted in the drawings will be readily apparent to those familiar with well drilling systems. For example, the bridges can be mounted to move longitudinally on linear rails so that the carriages of the draw work assemblies move in rectalinear motion above the drilling floor. This would be especially suitable in the land based structure depicted. However, the invention should not be construed as limited by the specific embodiments disclosed herein, but rather is defined in the claims appended hereto.

I claim:

1. A well drilling apparatus located within a confining structure having cylindrical annular vertically extending walls rising from a drilling floor and enclosing:

a plurality of rotary drilling tables laterally displaced from each other proximate to said drilling floor and within the confines of said walls each arranged to accommodate separate drilling assemblies including drilling pipe for drilling separate wells at spatially separated locations at said drilling floor;

an upright support extending upward relative to the drilling floor within said confining structure; and separate drilling draw work assemblies associated with and mounted in vertical displacement from each of said rotary drilling tables for manipulating the drilling pipe and other portions of the drilling assembly utilized with the associated rotary table, wherein each of said separate drilling draw work assemblies is mounted on a separate bridge that extends laterally from said upright support and is supported at said vertically extending walls at a distance above the rotary drilling table with which it is associated.

2. The well drilling apparatus of claim 1 further characterized in that each of said drilling assemblies is vertically displaced from the drilling table associated therewith by a distance of at least 45 feet.

3. The well drilling apparatus of claim 1 further characterized in that each of said separate drilling draw work assemblies includes a carriage that is mounted in mobile fashion on its bridge and each bridge extends laterally from said upright support and is supported at said walls to move in a horizontal plane.

4. The well drilling apparatus of claim 3 further characterized in that said bridges are each rotatable about said upright support to move horizontally, whereby the carriages of each of said drilling draw work assemblies may be moved into and out of vertical alignment with the rotary drilling table associated therewith.

5. The well drilling apparatus of claim 4 further characterized in that a master drilling draw work assembly is located in upward displacement above all of the aforesaid drilling draw work assemblies associated with said drilling tables, whereby said master drilling draw works can be selectively used to draw pipe from any one of said separate wells.

6. The well drilling apparatus of claim 5 further characterized in that said master drilling draw work assembly is mounted at least 90 feet above said rotary drilling table.

7. The well drilling apparatus of claim 5 further characterized in that said master drilling draw work assembly is mounted on a bridge that extends laterally across said confining structure and is supported at said vertically extending walls.

8. The well drilling apparatus of claim 7 further characterized in that said master drilling draw work assembly includes a carriage that is mounted in mobile fashion on its bridge for selective movement therealong.

9. The well drilling apparatus of claim 7 further characterized in that said bridge upon which said master draw work assembly is mounted is supported on an annular rail extending in a circle at the interior surface of said vertically extending walls and is powered for rotation in a horizontal plane, and said master drilling draw work assembly includes a carriage that is mounted in mobile fashion upon its bridge thereby allowing selected combinations of rotational and radial movement of said carriage of said master draw work assembly vertically extending walls, whereby said master draw work assembly may be vertically aligned with any one of said rotary drilling tables.

10. The well drilling apparatus of claim 1 wherein said confining structure is constructed with an internal framework of generally cylindrical configuration and at said walls that provides a plurality of vertically displaced annular rails are provided that are congruent in plan with said upright support at the center thereof providing support for bridges associated therewith at said vertically extending walls.

11. The well drilling apparatus of claim 10 wherein the external configuration of said confining structure is constructed according to a rectalinear plan.

12. An offshore drilling system for providing a land surface drilling environment for drilling in a body of water at the floor of said body of water comprising;

a hollow cylindrical water free cassion structure positioned to extend from the floor to the surface of said body of water and having a bottom seal at its lower extremity;

a plurality of rotary drilling tables mounted within said water free structure and close to said bottom seal for drilling wells through said bottom seal and into said floor;

drilling draw work means mounted within said water free structure and vertically above said rotary drilling tables for handling drill pipe and other equipment used in the course of drilling said wells, wherein said drilling draw work means comprises a plurality of drilling draw work assemblies each in association with a single one of said rotary drilling tables and mounted vertically above said drilling tables for concurrently handling pipe for several wells being drilled at the same time, and wherein said water free structure is constructed in cylindrical configuration and said plurality of drilling draw work assemblies are vertically spaced one from another therein and wherein each drilling draw work assembly is radially and circumferentially movable to permit the drilling of wells substantially across the entire exposed surface of said bottom seal.

13. A system as defined in claim 12 further comprising master draw work means located above the upper extremities of said drilling draw work assemblies and supported within and from said water free structure for moving heavy equipment within said structure.

14. A process as defined in claim 15 further comprising using said separate draw work assemblies to add drill pipe sections entirely within said caisson to drilling strings of pipe used with said rotary tables and using said master draw works alternatively and selectively to service each well entirely within said caisson to withdraw stands of pipe therefrom, each stand comprised of a plurality of drill pipe sections.

15. A process for affectuating concurrent drilling of a plurality of offshore wells within a hollow cylindrical longitudinally extending water free structure comprising:

floating said structure at the surface of a body of water to a drilling site where a plurality of wells are to be drilled concurrently at the floor of said body of water from within said structure, sinking one end of said structure to the floor of said body of water whereby said structure extends from the floor to the surface thereof, securing said sunken end in position at the floor of said body of water, installing a bottom seal at said sunken end of said structure, pumping out water from within said structure and maintaining said structure in a water free condition, mounting a plurality of rotary drilling tables at laterally displaced locations proximate said bottom seal, mounting a separate draw work assembly in association with each rotary drilling table vertically above the rotary drilling table vertically above the rotary drilling table with which it is associated, concurrently drilling a plurality of wells through said bottom seal into said floor of said body of water utilizing a separate rotary drilling table and draw work assembly for each well, and selectively servicing each of said wells with a master draw work of load capacity exceeding the load capacity of any one of said separate draw work assemblies.

* * * * *